United States Patent [19]

Buccicone

[11] 4,324,522

[45] Apr. 13, 1982

[54] METAL SHEET HANDLING MACHINE

[75] Inventor: Velio S. Buccicone, Portage, Ind.

[73] Assignee: Bucciconi Engineering Co., Inc., Gary, Ind.

[21] Appl. No.: 127,224

[22] Filed: Mar. 4, 1980

[51] Int. Cl.[3] ..... B65H 29/62; B65H 31/20

[52] U.S. Cl. ..... 414/51; 198/369; 198/861; 271/211; 271/224; 271/302; 414/91

[58] Field of Search ..... 414/51, 53, 88, 91, 414/900; 271/193, 223, 224, 211, 302, 303, 305; 198/369, 436, 437, 861

[56] References Cited

U.S. PATENT DOCUMENTS

| | | | |
|---|---|---|---|
| 2,497,149 | 2/1950 | Berdis et al. | 271/303 X |
| 2,882,048 | 4/1959 | Smith | 271/221 |
| 3,055,659 | 9/1962 | Buccicone | 271/224 |
| 3,140,090 | 7/1964 | Winkler et al. | 271/223 X |
| 3,159,398 | 12/1964 | Buccicone | 271/211 |
| 3,256,010 | 6/1966 | Buccicone | 271/223 |
| 3,640,372 | 2/1972 | Sarring | 198/436 |
| 3,942,784 | 3/1976 | Buccicone | 414/51 X |
| 4,132,400 | 1/1979 | Naramore | 271/211 X |

FOREIGN PATENT DOCUMENTS

| | | | |
|---|---|---|---|
| 1301610 | 7/1962 | France | 271/211 |

*Primary Examiner*—Leslie J. Paperner
*Attorney, Agent, or Firm*—Guy A. Greenawalt

[57] ABSTRACT

A metal sheet handling machine is disclosed which is characterized by a belt infeed conveyor with a belt tensioning arrangement and a mounting enabling the belt members to be readily removed laterally of the machine for replacement and when in operative position enabling leading end portions to be swung between two different levels, the normal raised position permitting sheets to advance across a pivoted gate to a horizontal carry over feed conveyor which advances the sheets across a reject piling area for deposit in one or more forwardly spaced sheet piling areas and the lowered position of the conveyor end portion permitting sheets to be advanced to a downwardly and forwardly inclined conveyor leading to a reject piling area, the pivoted gate being operable, when in lowered position, to bridge the gap between the discharge end of the infeed conveyor and the entrance end of the carry-over conveyor and when in raised position opening the gap and permitting entrance to the inclined reject conveyor when the end portion of the infeed conveyor is swung to lowered position.

10 Claims, 9 Drawing Figures

9
8
137
136
150
138
140
142
147
130
156
9

164
144'
90
70
136
146'
153'
138
142
143
150
140
145
142
143
152
153
137
146
144

METAL SHEET HANDLING MACHINE

BACKGROUND OF THE INVENTION

This invention relates to sheet handling apparatus and is more particularly concerned with improvements in apparatus for automatically sorting and piling or stacking metal sheets thereby enabling piles or stacks of the sheets to be more conveniently handled during processing, storage or shipment.

Various machines with pile forming apparatus have heretofore been developed for handling metal sheets as they are delivered from a fabricating line or advanced in a processing line. Machines employed for this purpose are illustrated, for example, in U.S. Pat. No. 3,055,659 granted Sept. 25, 1962 and in U.S. Pat. No. 3,228,682 granted Jan. 11, 1966. In U.S. Pat. No. 3,055,659 sheets of magnetizable material are advanced on an overhead traveling belt conveyor, with the sheets held on the belt by electromagnets, and in U.S. Pat. No. 3,228,682 sheets of either magnetizable or non-magnetizable material are held on an overhead traveling belt conveyor by vacuum. Various arrangements have been provided in such machines for guiding the sheets onto a pile or stack. For example, such arrangments are illustrated in U.S. Pat. No. 3,111,311 granted Nov. 19, 1963 and in U.S. Pat. No. 3,711,087 granted Jan. 16, 1973. Some of the machines of this type have included multiple pile forming arrangements with provision for classifying which enables the sheets to be divided and piled in separate piles. One such arrangement is illustrated in U.S. Pat. No. 4,130,206 granted Dec. 19, 1978. While these machines and others of like character have served the purposes for which they have been designed, they have usually had some limitations particularly with respect to the type or character of the material which they are capable of handling. Consequently, there has been a need for an improved machine for this purpose which is capable of handling sheets of either ferrous or non-ferrous materials of various sizes and configurations, which is of simplified construction, which is easy to operate, which requires minimum maintenance, and which can be fabricated with substantial economy in the use of materials.

It is a general object of the invention, therefore, to provide an improved machine for handling a variety of metal sheets of ferrous or non-ferrous material and which may be economically built with provision for advancing sheets so that they may be divided into separate classes or groups and delivered to separate piling areas.

It is a more specific object of the invention to provide a sheet piling machine having an improved arrangement for classifying the sheets so as to enable dividing of the sheets for delivery to separate piling mechanisms with means at the classifying area for closing a gap between the discharge end of the infeed conveyor and a horizontal forwarding conveyor when selected sheets are to be advanced on the forwarding conveyor for delivery to one piling mechanism and for opening the gap while lowering the discharge end of the infeed conveyor to enable adequate clearance for rapid transfer of sheets to be delivered to another piling mechanism.

Another object of the invention is to provide in a machine of the type described, a sheet advancing conveyor having associated means for selectively discharging the sheets in two separate paths which are in vertically spaced relation and which lead to separate piling areas.

Another object of the invention is to provide in a machine of the type described an infeed conveyor having continuously traveling sheet supporting and conveying elements which are carried on rotating end support members mounted so as to provide a top path in a generally horizontal plane with the leading end normally positioned to deliver the sheets across a pivotally mounted gate to a carry-over conveyor, and with portions at the leading end of the infeed conveyor being swingable to a downwardly inclined position so as to permit selected sheets to be delivered, when the pivoted gate is raised, to a downwardly and forwardly inclined conveyor leading to a piling area, the pivoted end of the infeed conveyor serving to support and guide the sheets as they are advanced across the gate to the carry-over conveyor or beneath the gate to the downwardly inclined conveyor and the pivoted gate serving, when in normal position, to bridge the gap between the infeed and carry-over conveyors and, when swung to a raised position, to clear the entrance to the downwardly inclined conveyor.

A further object of the invention is to provide, in an apparatus of the type described wherein a leading portion of the infeed conveyor is swingable between a normal horizontal position and a downwardly inclined position, a tensioning arrangement for the traveling elements of the infeed conveyor which automatically maintains a predetermined tension in the traveling elements when the conveyor end is swung to the downwardly inclined position.

A still further object of the invention is to provide a piling machine for metal sheets wherein the sheets are fed to the machine on a traveling conveyor and selectively advanced to a piling area having end stop and back stop mechanisms with the back stop comprising a swivel arrangement with a passage for air to aid in the piling of the sheets.

To this end the invention as claimed herein is embodied in a machine which is adapted for piling metal sheets and which comprises a supporting frame having mounted thereon a sheet supporting and advancing conveyor having continuously traveling sheet carrying members mounted on longitudinally spaced rotatably mounted end support members with an intermediate support member for the top conveyor run which is spaced a predetermined distance from the support member at the discharge end of the conveyor, the end support member being mounted for hinged vertical movement between a raised position where the top conveyor run is horizontal and a lowered position so as to enable selected sheets to be advanced, when the end support member is in the raised position, across a pivotally mounted gate to a forwarding conveyor for delivery to a piling mechanism and when the end support member is lowered and the pivoted gate is swung upwardly to open the gap between the discharge end of the infeed conveyor and the forwarding conveyor so as to enable sheets to be delivered into the gap and to a downwardly directed ramp leading to a lower level piling area below the forwarding conveyor with means for automatically maintaining tension in the continuously traveling sheet support members.

The aforesaid objects and other objects and advantages of the invention will become more apparent when reference is made to the accompanying detailed description of the preferred embodiment of the invention which is set forth in the accompanying drawings wherein like reference numerals indicate corresponding parts throughout.

DESCRIPTION OF THE PREFERRED EMBODIMENT OF THE INVENTION

Figure 1:
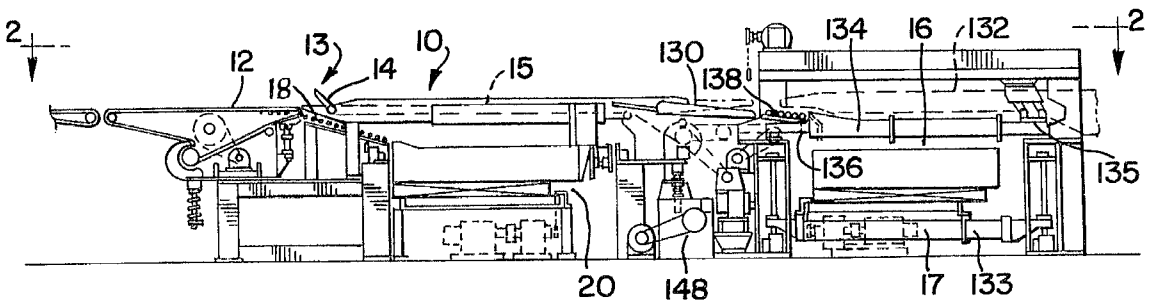
FIG. 1 is a side elevation of a sheet piling machine which embodies the principle features of the invention.
Figure 2:
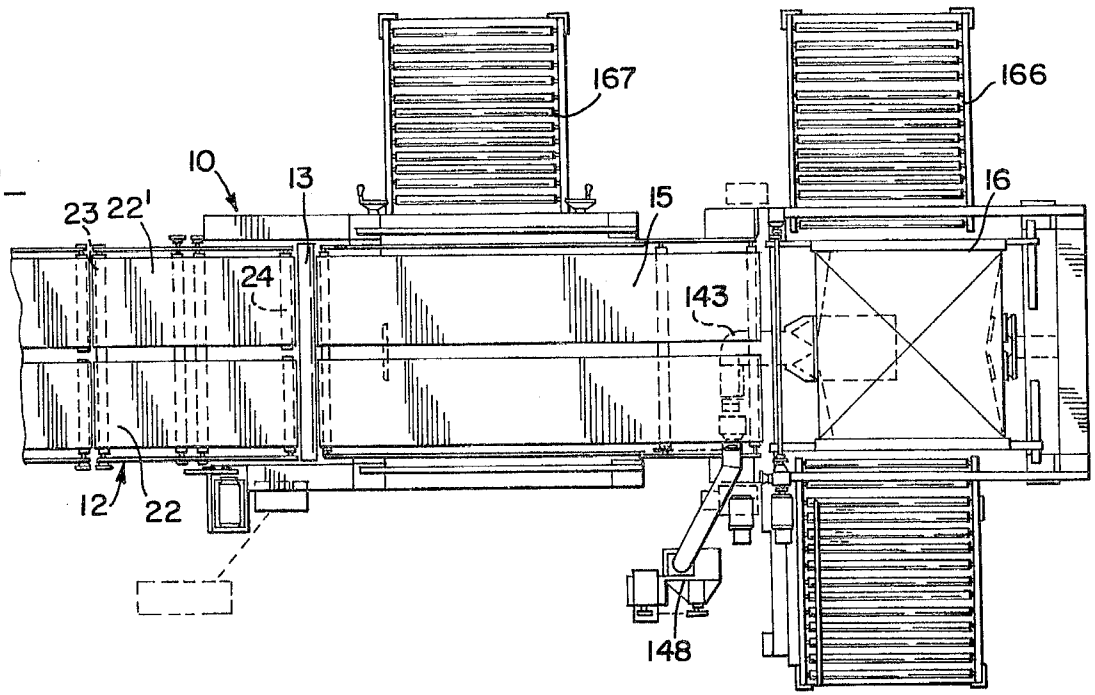
FIG. 2 is a plan view of the piling machine shown in FIG. 1, the view being taken on the line 2—2 of FIG. 1.

Referring first to FIGS. 1 and 2, there is illustrated a sheet piling machine 10 which is the presently preferred form of the invention. The sheets are fed from a supply source to an infeed conveyor assembly 12 having a top run on which successive sheets are advanced to a selection area 13 where acceptable sheets are advanced over a pivotally mounted gate structure 14 to the top run of a forwarding conveyor assembly 15. The forwarding conveyor 15, which serves as a prime pile infeed conveyor, advances the sheets to a prime piler area 16 for deposit on a sheet accumulating piler structure 17. Sheets which are not acceptable, that is, rejects, are diverted, at the classifying area 13, by operation of the conveyor assembly 12 and the cooperating pivotally mounted gate structure 14, onto a downwardly and forwardly inclined ramp 18 which delivers the diverted sheets into a reject piler area 20 located beneath the conveyor assembly 15. The two piling areas 17 and 20 in the illustrated machine, each accommodate mechanism for accumulating the sheets in a pile and mechanism for removing the pile from the machine.

The infeed conveyor structure 12, as shown, (FIGS. 3 and 5) comprises a pair of wide belts 22, 22′ which are carried on longitudinally spaced roller assemblies 23 and 24 mounted at opposite ends of a belt support frame assembly. The support frame assembly 25 comprises laterally spaced two-part main side frame plates or plate assemblies 26 and 26′ which are disposed in laterally spaced vertical planes. The side plate assemblies 26, 26′ are connected by a cross channel 27 at the entrance end of the frame 25 and a cross bar in the form of a tube 28 (FIGS. 3 and 5) at the forward end of the frame 25. The two belts 22, 22′ travel on the support roller 23 at the entrance end of the frame 25 which is journaled at its opposite ends in the frame side plates 26 and 26′. At the leading or discharge end of the support frame structure 25 the belts are supported on the roller assembly 24 which comprises a pair of axially aligned rollers 30, 30′, extending between spaced vertically disposed side members 32, 32′ of a small cross frame 33 which cross frame extends at the forward end of the frame 25. The rollers 30, 30′ are journaled at opposite ends in the side plate members 32, 32′ and supported by a small bracket plate 34 in the middle of the frame 33 which extends forwardly of a cross channel member 35 connecting the side plate members 32 and 32′. The cross frame 33 is rectangular and the side plate members 32 and 32′ which are disposed in transversely spaced vertical planes are pivotally connected at their rear ends adjacent the forward ends of uppermost plate members 36, 36′ of the side frame plate assemblies 26 and 26′ by means of bearing assemblies 38 at opposite ends of a pair of transversely aligned idler rollers 40 and 40′ which are mounted on a shaft 42 journaled in the side frame plate members 36 and 36′ by means of the bearing assemblies 38, the latter providing the pivot support for the trailing ends of the small cross frame side plate members 32 and 32′. The pivotally mounted end cross frame 33 has a limited swinging movement in a vertical path which is controlled by mechanism hereinafter described.

The belt carrying portion of the frame structure 25 constitutes the upper portion of a main support frame for the belt carrying members and associated belt driving and tensioning apparatus. The lowermost portion 43 of the frame structure 25 is mounted on a lower base frame 44 constituting a support structure for the entire machine. The lower main frame portion 43 comprises side plate members 45 and 45′ which are disposed in the vertical planes of the upper side frame plate members 36 and 36′. The bottom side plate members 45 and 45′ are upstanding from a bottom cross plate 46 (FIG. 4) and are connected at the forward edges by a vertically disposed cross plate member 47 which extends upwardly to a belt supporting cross roller assembly 50. The roller assembly 50, which is in two equal sections, is journaled at opposite ends in top forward portions of the side plate members 45 and 45′ and, at the center of the frame, in a center support plate 51 which is disposed in a vertical plane paralleling the plane of the side plate members 45 and 45′. The roller assembly 50 is spaced vertically beneath the pivoted end cross frame 33 and supports the lower run of the belts at a predetermined distance from the leading end of the cross frame 33.

The end cross frame 33 is pivotally mounted on the bearings 38 to swing about the axis of the idler rollers 40 and 40′ and the swinging movement is controlled by an air cylinder 52 which is mounted at the transverse center of the support frame. The cylinder 52 is pivoted at 53 on a bracket plate 54 extending forwardly of the cross plate 47 with its upwardly extending piston rod 55 pivoted at 56 on a bracket 57 extending from the cross frame channel 35. A movement equalizing shaft 58 is journaled between the side frame plates 45 and 45′ and carries at one end a radial arm 60 which is pivoted at its outer end to the lower end of a link member 61. The link member 61 has its upper end pivoted to the bracket plate 34 which supports rollers 50, 50′ at the center of the pivotally mounted end cross frame 33. A counterbalance for frame 33 is provided which comprises a compression spring 63 mounted on a headed pin 64 which extends in vertically aligned apertures in an outwardly directed top flange formation 65 on the cross frame side plate 32 and a cooperating small shelf plate 66 extending outwardly of the support frame side plate 36 and below the bearing 38. The spring 63 is positioned on the pin 64 between the members 65 and 66 and forwardly of the bearing 38, with the pin 64 free to slide in the aperture in the bottom plate 66.

Figure 3:
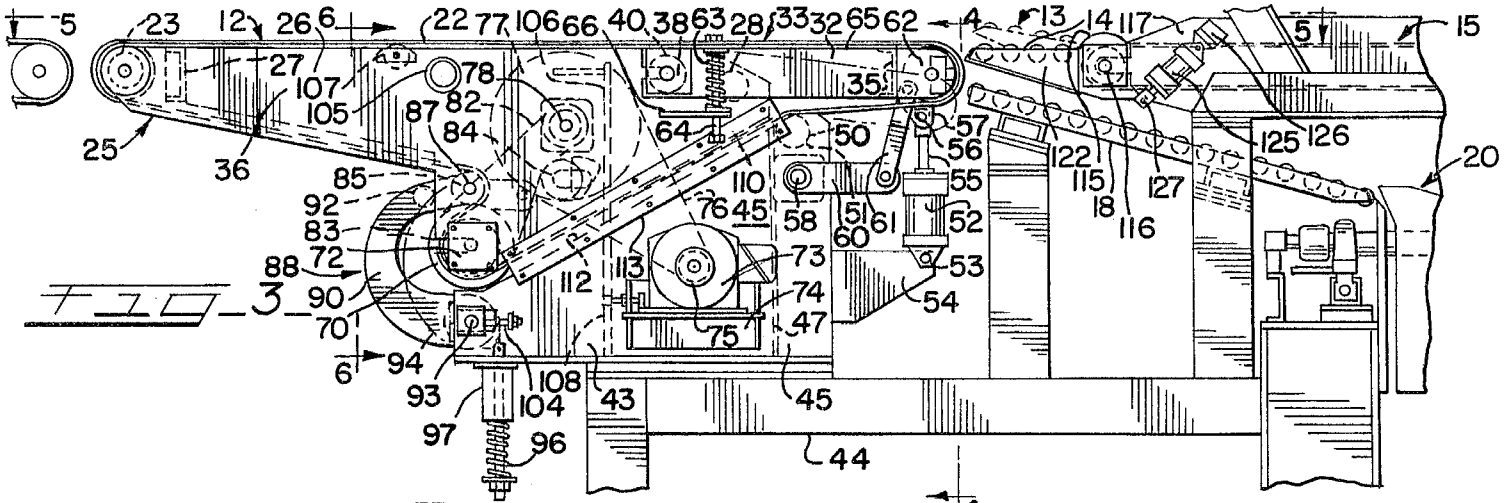
FIG. 3 is a side elevation, to an enlarged scale, of the entrance end of the machine of FIG. 1.
Figure 4:
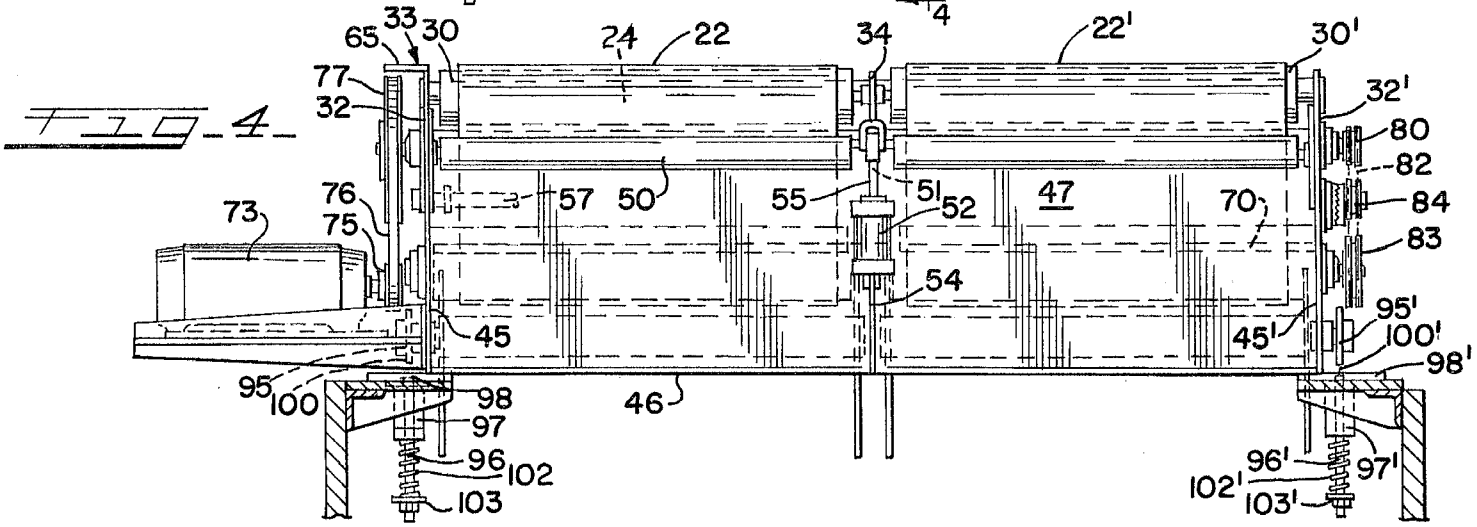
FIG. 4 is a cross sectional view taken on the line 4—4 of FIG. 3.
Figure 5:
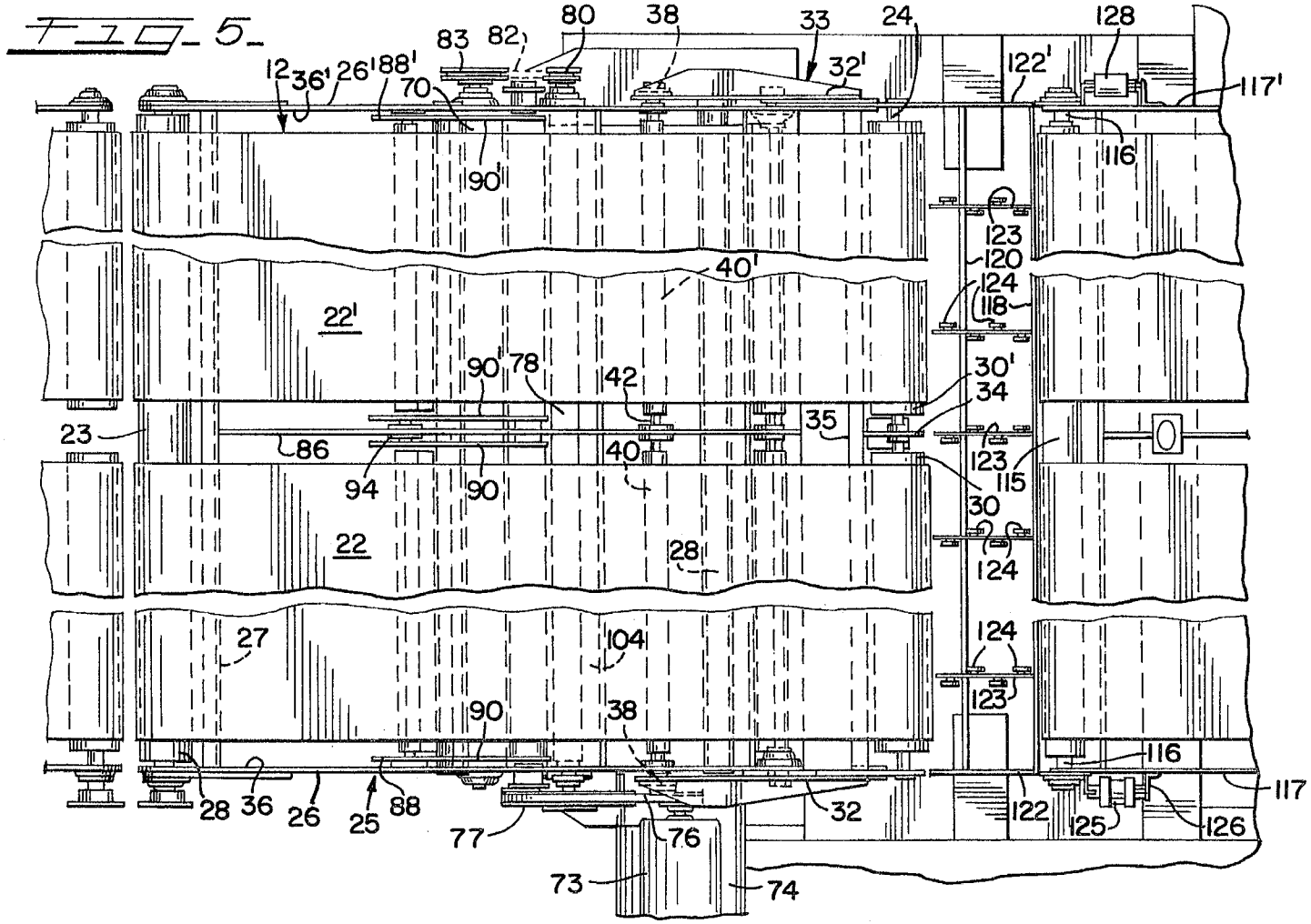
FIG. 5 is a plan view of the entrance end of the machine, to an enlarged scale and with portions broken away, the view being taken on the line 5—5 of FIG. 3.
Figure 6:
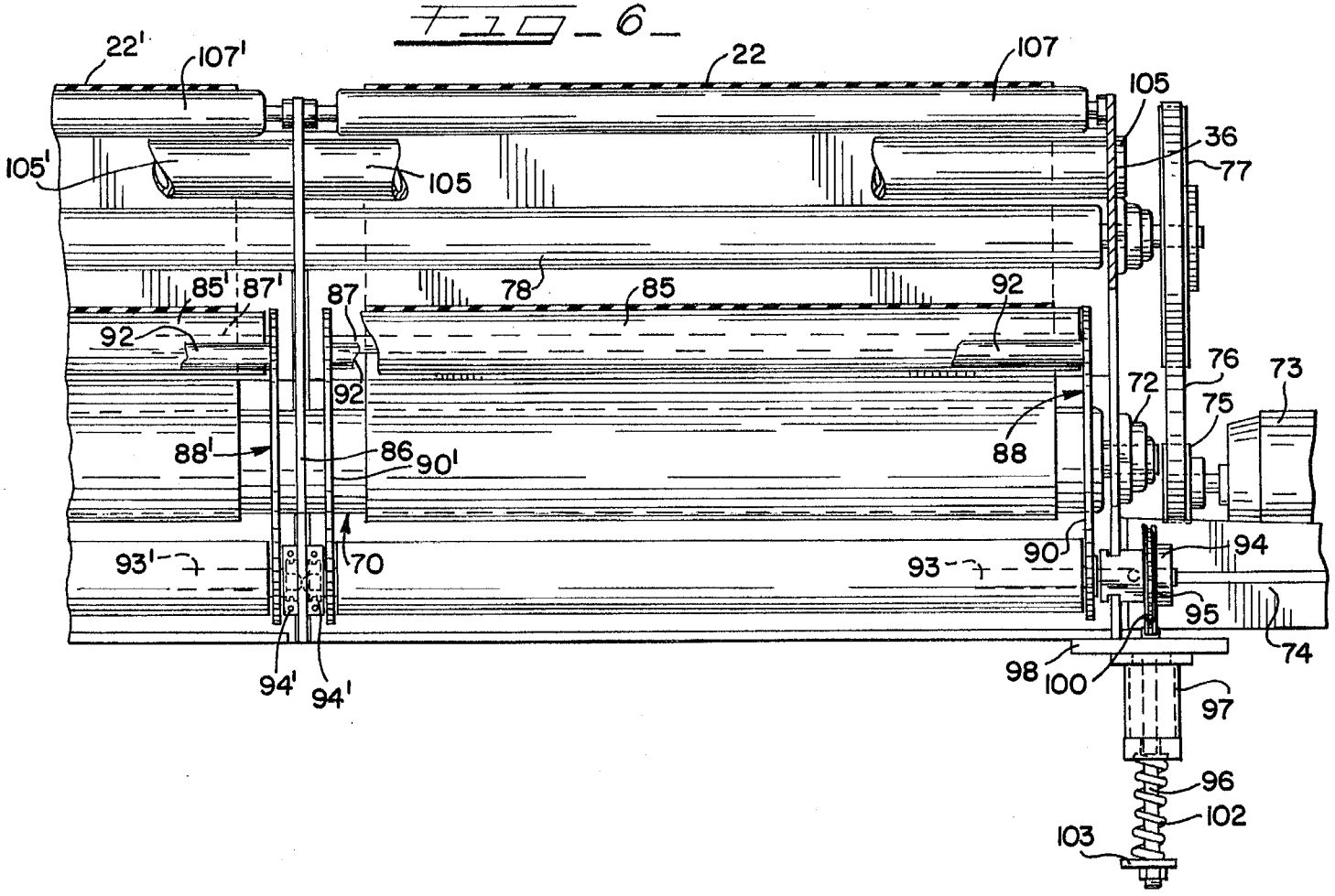
FIG. 6 is a fragmentary sectional view, taken on the line 6—6 of FIG. 3, to an enlarged scale with portions broken away or omitted.

The return run of the belts 22, 22' extends from the roller assembly 50 rearwardly and downardly to a drive roller assembly 70 (FIGS. 3 and 6) which is journaled, at its opposite ends, in downwardly extended portions of the top frame side plate members 36 and 36' by means of bearing members 72. The belt drive roller has a drive train connection with a drive motor 73 (FIGS. 3, 4 and 5). The drive motor 73 is mounted on a support bracket 74 secured at one side of the machine on the lower margin of the bottom frame side plate 45. The motor drive pulley 75 is connected by a timing belt 76 with a pulley 77 on the extended end of the drive shaft 78 which is journaled at its opposite ends in the upper side frame plates 36 and 36'. At the opposite side of the machine, the drive shaft 78 carries on its extended end a sprocket 80 which is connected by the drive chain 82 with a sprocket 83 on the end of the shaft of the drive roller assembly 70 so as to drive the latter. The drive chain 82 has an associated conventional tension adjusting sprocket 84 (FIG. 3).

A belt tensioning apparatus (FIGS. 3 to 6) is provided to automatically take up any slack in the return run of the belts 22, 22' when the forward end section of the conveyor is lowered by swinging cross frame 33 downwardly and to maintain tension in the belts 22, 22' in all positions of the end cross frame 33. The tensioning mechanism comprises a pair of belt engaging rollers 85, 85' (FIGS. 3 and 6) disposed on opposite sides of a vertical center frame plate 86 (FIG. 5). Each of the rollers 85, 85' is rotatably carried on a shaft 87, 87' which shafts form part of swingably mounted roller carrying tension frames 88, 88', of identical construction. Each of frames 88, 88' comprises a pair of arm forming end members 90, 90' which are in the form of plates cut so as to have a U-shaped, semi-circular or crescent configuration. Each pair of the bracket forming arm members 90, 90' is connected by a cross brace member 92 (FIG. 6) near the top ends of the end members 90, 90'. The frames 88, 88' are each swingably mounted for rotation on a transverse axis by means of a cross bar 93, 93'. Each cross bar 93, 93' extends between and is journaled at its opposite ends in bearing formationa 94, 94' which are mounted in the rearmost margins of the associated bottom side plate members 45, 45' and the vertically disposed center frame plate 86. The bearing axes, which are aligned, are disposed in parallel relation with and directly beneath the axis of the belt drive roll assembly 70. The shaft forming cross bars 93, 93' are extended at opposite sides of the machine and a small sprocket 95, 95' is secured on each extended end thereof adjacent the associated side plate member. A spring tensioned rod 96, 96' is slidably mounted in a tubular housing 97, 97' depending below the flange forming plate member 98, 98' at the bottom of the side plates. The housing 97, 97' has a base flange secured to the bottom face of the flange plate 98, 98' and the latter is apertured to enable the upper end of the tensioning rod 96, 96' to extend above the same where it has its top end pivotally connected to the endless chain 100, 100' which has a length somewhat greater than the periphery of the associated sprocket 95, 95' on which it is mounted. The pivotal connection with the chain is at a point spaced forwardly of the periphery of the sprocket 95, 95' so that downward pull along the axis of the rod 96, 96' will rotate the sprocket 95, 95' and the cross bar 93, 93' so as to tilt the roller carrying frames 88, 88' forwardly. The rod 96, 96' is tensioned by a spring 102, 102' which is carried on the lower end of the rod 96, 96' between the bottom end of the rod housing 97, 97' and a nut held washer 103, 103' which may be taken up by the nut. The innermost bearings 94', 94' permit that end of the shafts 93, 93' to pivot while the outermost bearing members 94, 94 are slidable horizontally in slots in the side plates and positioned by an adjusting bolt 104 (FIG. 3) so as to enable the bearing members 94, 94 to be moved back and forth and adjust the belt tracking.

The C-shaped or crescent shaped configuration of the arm forming end members 90, 90' of the roller carrying tension frames 88, 88' permits the frames to swing to a position where, in effect, the end arms straddle the drive roller assembly 70. This enables the belt engaging rollers 85, 85' to be moved a substantial distance in tensioning the belts 22, 22', the latter being quite heavy when the machine is built to handle large and heavy plates or sheets of steel or similar material. The adjusting arrangement permits fine tracking and tensioning of the belts.

The upper frame side plates 36 and 36' (FIGS. 3, 4 and 5) are connected by a bracing tube 105 extending between the same in addition to the cross frame members 27 and 28. Also, a vertically disposed transverse frame plate 106 extends between the plates 36, 36' which has a narrow top flange portion. One or more belt supporting idler rollers 107 may be provided for the sheet carrying upper run of the belts 22, 22'. A vertically disposed transverse frame plate 108 extends between the lower side plate members 45, 45', in vertical alignment with the cross plate 106 and cooperates with the forward vertical plate 47 in bracing the bottom side wall forming plate members 45, 45'. The lowermost edge 110 of each side plate 36, 36' is spaced from the confronting topmost edge 112 of the associated bottom side plate 45, 45' a sufficient distance to permit passage of a belt member 22, 22' and a readily removable cover plate 113 is provided which is bolted or otherwise secured over the opening. Upon removal of the cover plates 113 and release of the belt tension both of the belts 22, 22' may be readily removed laterally of the machine, for repair or replacement, with minimum labor and minimum loss of time since there is no need to remove rolls or tensioning and tracking mechanism.

The swingable gate structure 14 (FIGS. 3 and 5) is mounted for swinging movement on the transverse axis of the roll assembly 115 at the entrance end of the carry over conveyor 15, the latter being a side by side double belt arrangement of the same general construction as the conveyor 12. The entrance roll assembly 115 of the carry over conveyor includes a transverse shaft 116 which extends between side plates 117 and 117' and has its end journaled in these plates. The gate 14, which is relatively short in the direction of sheet travel, comprises a frame structure formed by a pair of spaced cross bars 118 and 120 extending between end plates 122 and 122' which end plates are pivotally mounted in vertically disposed relation on the ends of the roll shaft 116. A plurality of roller carrying bars 123 are spaced transversely of the machine and along the cross bar 118 which extend normal to the axis of the roll assembly 115. Each of the bars 123 has mounted thereon a plurality of skate rollers 124 for supporting the sheets as they travel across the gate 14. The swinging movement of the gate 14 is controlled by an air cylinder 125 which is pivotally mounted on a bracket 126 on the conveyor frame side or end plate 117 of the conveyor frame. The cylinder piston is pivotally connected to a corner portion of the gate end frame plate 122 at the point 127 which is spaced radially of the axis of the roll shaft 116 so as to swing the gate between a lowered and a raised position, the latter being indicated in phantom line in FIG. 3. A spring counterbalance 128 is provided at the opposite side of the gate frame which is mounted on brackets on the conveyor side frame plate 117' and the gate frame plate 122'. A relatively short gate may be employed with the pivoted end structure on the driven infeed conveyor even when heavy material is to be handled which may be too stiff to bend down naturally of its own weight in a short distance. The combination of the pivoted end structure on the infeed conveyor and the relatively short gate enables movement of the sheet gradually in a downward direction into the reject piler. The upward position of the gate prevents damage to the entrance rolls when the leading portion of an advancing sheet flies ahead and strikes the bottom of the gate which forces it in the downward direction. Short sheets will of course better bridge the short gate and advance over the same when the gate is down without requiring the gate rolls to be driven thus eliminating the need for complicated roll drive mechanism which adds undesirable weight and slows down the motion of the sheets and the motion of the gate.

The conveyor 15 (FIGS. 1 and 2) extends in a plane above the reject piling area 20 to the entrance to the piling mechanism 17 in the prime piling area 16. The conveyor 15 has a pivotal section 130 at the discharge end with a suitable operating mechanism (not shown) for raising and lowering the same. The construction may be the same as the construction of the pivoted end section of conveyor 12. In the lowered position of the end section 130 sheets will be directed into the piling area 16 while in the raised position sheets will be advanced to a forwarding conveyor, indicated at 132, which may be arranged above the piling mechanism 17 for advancing sheets to a further piling area when multiple piling is desired.

Figure 7:
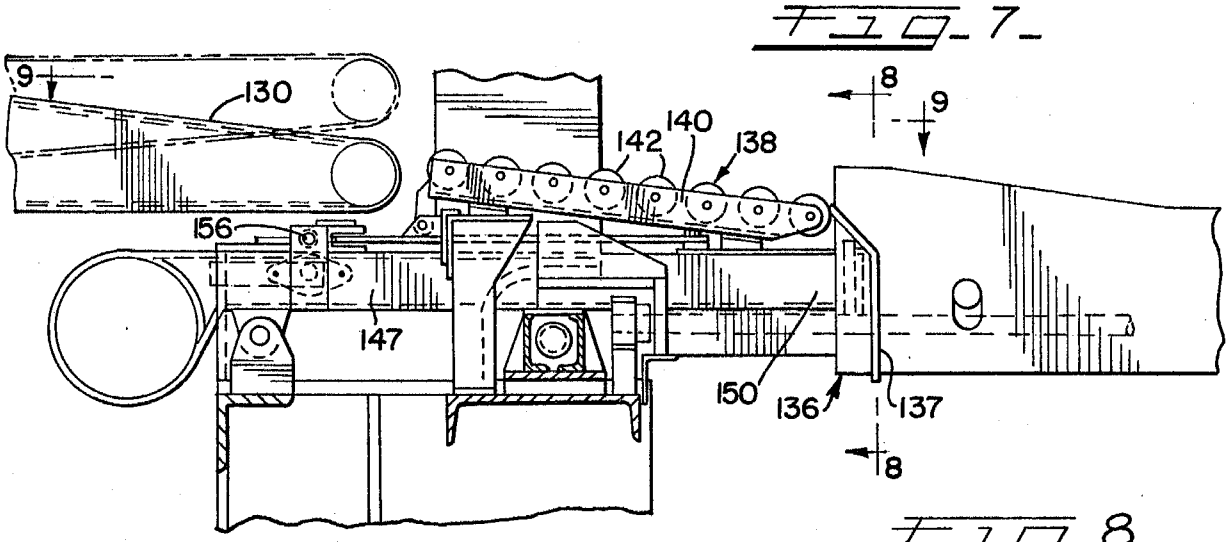
FIG. 7 is a side elevational view with parts in section, at the entrance to the prime piler area.
Figure 8:
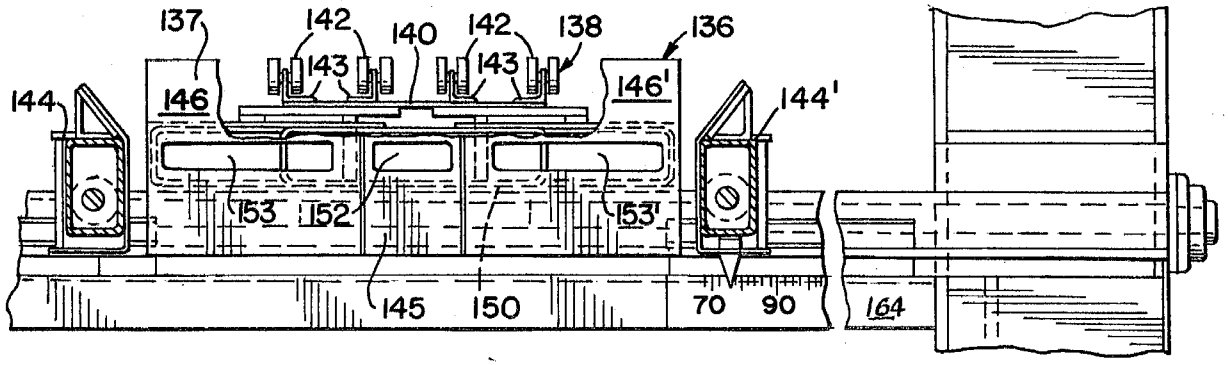
FIG. 8 is a fragmentary cross sectional view, taken on the line 8—8 of FIG. 7.
Figure 9:
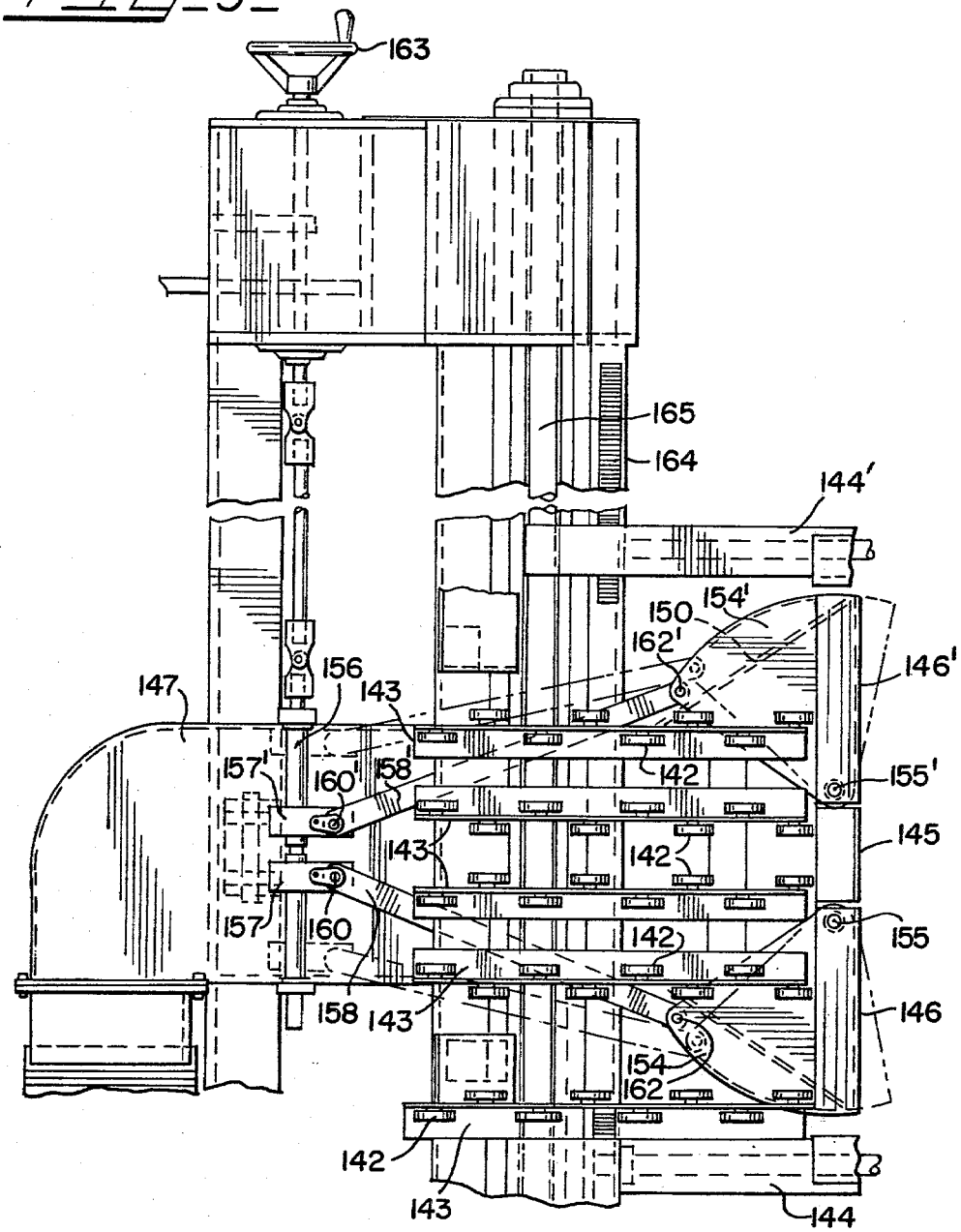
FIG. 9 is a fragmentary plan view, taken on the line 9—9 of FIG. 8.

The prime piling mechanism 17 (FIG. 1) will include a pile supporting hoist 133 on which successive sheets are piled, an adjustable side guide mechanism 134, an adjustable end stop mechanism 135 and a back stop mechanism 136. The back stop mechanism 136 (FIGS. 7 to 9) is positioned with its sheet engaging face 137 at the leading end of a ramp structure 138. The ramp structure 138 comprises a frame 140 and a plurality of skate wheels 142 mounted on supporting angle bars 143 which may be adjusted laterally of the machine. The ramp 138 is inclined forwardly and downwardly so as to receive sheets from the discharge end of the conveyor 15 and deliver them between the vertical faces of the spaced side guide members 144, 144'. The sheet engaging face 137 of the back stop 136 comprises a center plate 145 and a pair of pivotally mounted wing forming side plates 146 and 146'. The center plate member 145 is mounted at the leading end of an air conduit 147 extending from an air source, which, in the machine shown, is a motor driven blower 148 (FIG. 2). The conduit 147 has a widened section 150 at the end on which the plates 145 and 146, 146' are mounted so as to deliver air to the apertures 152 and 153, 153' in the plates 145 and 146, 146'. Each of the hinged plates 146, 146' has a chamber forming member 154, 154' of triangular configuration extending from its back face which telescopes the end section 150 of the conduit 147 so as to provide air passages to the apertures 153, 153' in the plates 146, 146' in all positions of the plates. The plates 146, 146' and associated connecting air chamber formations 154, 154' are pivotally mounted on laterally spaced vertically disposed pivot pins 155, 155' in the end portoion 150 of the conduit 147 so they may be swung forwardly to accomodate chevron cut sheets. The angle of the wing plates 146, 146' is adjusted by means of a transverse adjusting screw 156 having right and left hand threads on which follower nuts 157, 157' are carried. The traveling follower nuts 157, 157' are connected to the top plates of the air chamber members 154, 154' by means of link members 158, 158' which link members are pivoted, at 160, 160' at one end to the nuts 157, 157' and at the opposite ends to the chamber members 154, 154' at 162, 162'. The adjusting screw 156 is provided with an operating handle or wheel 163. A transversely mounted scale member 164 is provided with marking showing the degrees of the chevron cut. The associated plate guiding and pile support members may be constructed and operated as shown in prior piling machines. For example, the hoist 133 may be constructed as shown in U.S. Pat. No. 3,369,675 granted Feb. 20, 1968. The end stop mechanism 135 may be the type shown in U.S. Pat. No. 3,061,305 granted Oct. 30, 1962. The side guide mechanism may be of the type shown in U.S. Pat. No. 3,061,305 with the side guide members 144 and 144' having a right and left hand thread connection with a transverse adjusting screw 165. A driven roller conveyor 166 is provided for handling the pallets and the pile or packs of sheets. The pack conveyor 166 for the prime piler is divided into three sections, the pallet conveyor which extends at one side of the hoist, the hoist conveyor, and the discharge pack conveyor which extends at the opposite side of the machine. Each of the three sections has its own drive motor and the operation can be individually or in tandem. The pallet conveyor may have a stop device 167 which is adjustable for aligning one edge of the pallets when they are put on by a fork lift truck.

The reject pack conveyor 167 (FIG. 2) is simplified by providing one long roller conveyor table and arranging the one side guide member so that it can be elevated or swung to a position which will permit removal of the pack on the conveyor at that side of the machine.

The machine may be provided with suitable electrical control mechanism for operating the air cylinders 52 and 125 and any other movable or adjustable elements in addition to the drive mechanism. The control mechanism may include scanners for automatic adjustment, if desired.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A piling machine for metal sheets comprising a sheet advancing infeed conveyor having an endless traveling belt carried on spaced rotatable end members which are mounted on a horizontally disposed support frame with the discharge end of said conveyor terminating adjacent a first pile forming apparatus and in spaced relation relative to the entrance end of a further horizontally disposed sheet advancing conveyor which extends across the first pile forming apparatus to a second pile forming apparatus, said infeed conveyor has a bottom return run and a belt driving roller which is disposed on a transverse axis so as to engage the top surface of the bottom run of the belt and a belt tracking and tensioning control means which comprises a belt engaging roller mounted on a hinged frame adjacent said driving roller and means urging said frame into a position to hold the roller mounted thereon in resilient engagement with the bottom surface of the bottom run of said belt so as to maintain tension in said belt, said infeed conveyor having a sheet carrying top run which is aligned with the sheet carrying top run of said further sheet advancing conveyor, said infeed conveyor having a rotatable end member at the discharge end of said infeed conveyor which is supported on a hingedly mounted end section of said conveyor support frame, said frame end section having a relatively small dimension in the direction of travel of the belt, and means for moving said frame end section between a normal horizontal position and a downwardly and forwardly inclined position, the latter position directing an advancing sheet on the infeed conveyor to a downwardly inclined conveyor in the form of a ramp leading to said first piling apparatus, and a swingably mounted flop gate structure at the entrance end of said further conveyor which is of relatively small dimension in the direction of travel of the sheets, and which, in its normal horizontal position, bridges the gap between the discharge end of the infeed conveyor and the receiving end of said further conveyor so that an advancing sheet on said infeed conveyor is carried over onto said further conveyor, and means for moving said flop gate structure between its normal horizontal position and an upwardly inclined position where it opens the gap between the conveyors and cooperates with the hinged end section of said infeed conveyor in directing a sheet advancing on said downwardly inclined end section of said infeed conveyor to said first pile forming apparatus.

2. A piling machine as set forth in claim 1 wherein said hinged frame has one end thereof mounted on a pivoted bearing and the other end thereof mounted for adjustment toward and from the axis of said driving roller so as to enable fine adjustment of the belt tracking.

3. A piling mechanism as set forth in claim 1 wherein said means for moving said end frame on said infeed conveyor between said normal position and said inclined position comprises a fluid cylinder.

4. A piling mechanism as set forth in claim 1 wherein said hingedly mounted end section at the discharge end of said infeed conveyor comprises side frame members which are mounted for swinging movement on an axis coinciding with the axis of a belt supporting member which is mounted on said conveyor frame in spaced relation to the belt supporting member at that end of the conveyor support frame.

5. A piling machine as set forth in claim 4 wherein said infeed conveyor end frame has a spring counterbalance arrangement.

6. A piling machine as set forth in claim 1 wherein said flop gate structure comprises a generally rectangular frame having sheet supporting skate wheels mounted on a plurality of bar members which extend in the direction of sheet travel.

7. A piling machine as set forth in claim 1 wherein said flop gate structure comprises a generally rectangular frame with side plate members which are pivotally mounted for movement on an axis coinciding with the axis of a belt support member at the entrance end of said further conveyor.

8. A piling machine for metal sheets comprising a sheet advancing infeed conveyor having an endless traveling belt carried on spaced rotatable end members which are mounted on a horizontally disposed support frame with the discharge end of said conveyor terminating adjacent a first pile forming apparatus and in spaced relation relative to the entrance end of a further horizontally disposed sheet advancing conveyor which extends across the first pile forming apparatus to a second pile forming apparatus, said infeed conveyor comprises a pair of endless belts of substantial width and said belt support frame has belt end support members which are arranged to carry said wide belts in side by side relation, said belt support frame including parallel upstanding center frame and side members in the form of plates with said side members being slotted so as to permit the belt members to be removed laterally of the machine with portions thereof moving through said side frame slots, and a readily removable cover for said slots, said infeed conveyor having a sheet carrying top run which is aligned with the sheet carrying top run of said further sheet advancing conveyor, said infeed conveyor having a rotatable end member at the discharge end of said infeed conveyor which is supported on a hingedly mounted end section of said conveyor support frame, said frame end section having a relatively small dimension in the direction of travel of the belt, and means for moving said frame end section between a normal horizontal position and a downwardly and forwardly inclined position, the latter position directing an advancing sheet on the infeed conveyor to a downwardly inclined conveyor in the form of a ramp leading to said first piling apparatus, and a swingably mounted flop gate structure at the entrance end of said further conveyor which is of relatively small dimension in the direction of travel of the sheets, and which, in its normal horizontal position, bridges the gap between the discharge end of the infeed conveyor and the receiving end of said further conveyor so that an advancing sheet on said infeed conveyor is carried over onto said further conveyor, and means for moving said flop gate structure between its normal horizontal position and an upwardly inclined position where it opens the gap between the conveyors and cooperates with the hinged end section of said infeed conveyor in directing a sheet advancing on said downwardly inclined end section of said infeed conveyor to said first pile forming apparatus.

9. In a sheet piling machine having a pile supporting member, an end stop device and a back stop device, said back stop device comprising a sheet edge engaging forward face formed by a vertically disposed center plate member and hingedly connected wing forming side plate members adapted to be swung forwardly into angular relation relative to the center plate member, said plate members each having one or more apertures permitting the passage of an air stream, a conduit extending rearwardly of said plate members and to an air supply member and means forming air passageways connecting said conduit and said plate members so as to enable flow of air from said conduit through said passageways, said means forming said air passageways comprising chamber forming members secured on the back face of each of said wing forming side plate members which chamber members are hinged on an axis adjoining the opposite side edges of said center plate member and said means forming said passageways telescoping the end portion of said conduit.

10. In a sheet piling machine as set forth in claim 9 and said means forming said passageways comprising chamber forming members each having a pivoted connection with a link member which is pivoted at its opposite end to a traveling nut mounted on a threaded portion of a transversely extending control rod.

* * * * *